United States Patent [19]

Rademacher

[11] Patent Number: 4,671,048

[45] Date of Patent: Jun. 9, 1987

[54] HIGH SPEED, LOW VIBRATION BREAD BAGGER

[75] Inventor: Robert E. Rademacher, Richmond, Va.

[73] Assignee: Automated Machinery Systems, Inc., Richmond, Va.

[21] Appl. No.: 872,160

[22] Filed: Jun. 9, 1986

[51] Int. Cl.[4] ..... B65B 43/44; B65B 39/02

[52] U.S. Cl. ..... 53/572; 53/385

[58] Field of Search ..... 53/571, 572, 384, 385, 53/459, 573

[56] References Cited

U.S. PATENT DOCUMENTS

| | | | |
|---|---|---|---|
| 3,358,414 | 12/1967 | Hersh et al. . | |
| 3,421,286 | 1/1969 | Chambless, Jr. . | |
| 3,421,287 | 10/1966 | Sheets . | |
| 3,451,192 | 6/1969 | Irwin | 53/385 X |
| 3,538,671 | 11/1970 | Wallace | 53/385 |
| 3,556,316 | 1/1971 | Marasso et al. | 53/385 X |
| 3,618,292 | 11/1971 | Rademacher | 53/261 |
| 3,783,580 | 1/1974 | Raudys . | |
| 3,930,352 | 1/1976 | Carnes | 53/384 |
| 4,148,169 | 4/1979 | Zike . | |
| 4,221,106 | 1/1981 | Altenophl . | |
| 4,245,453 | 9/1980 | Altenophl . | |

*Primary Examiner*—Horace M. Culver

*Attorney, Agent, or Firm*—Willian Brinks Olds Hofer Gilson & Lione

[57] ABSTRACT

A high speed, low vibration bread bagger in which the top and bottom bag scoops move smoothly and solely horizontally by means of swinging pivot means that is suspended by hanger arms from the frame of the apparatus. Pneumatic means coupled to the pivotable top scoop support arm causes the top scoop to exert substantially the same force against the open mouth of a bag that is pulled over a loaf of bread, regardless of the diameter of the bags used.

11 Claims, 12 Drawing Figures

Fig. 1
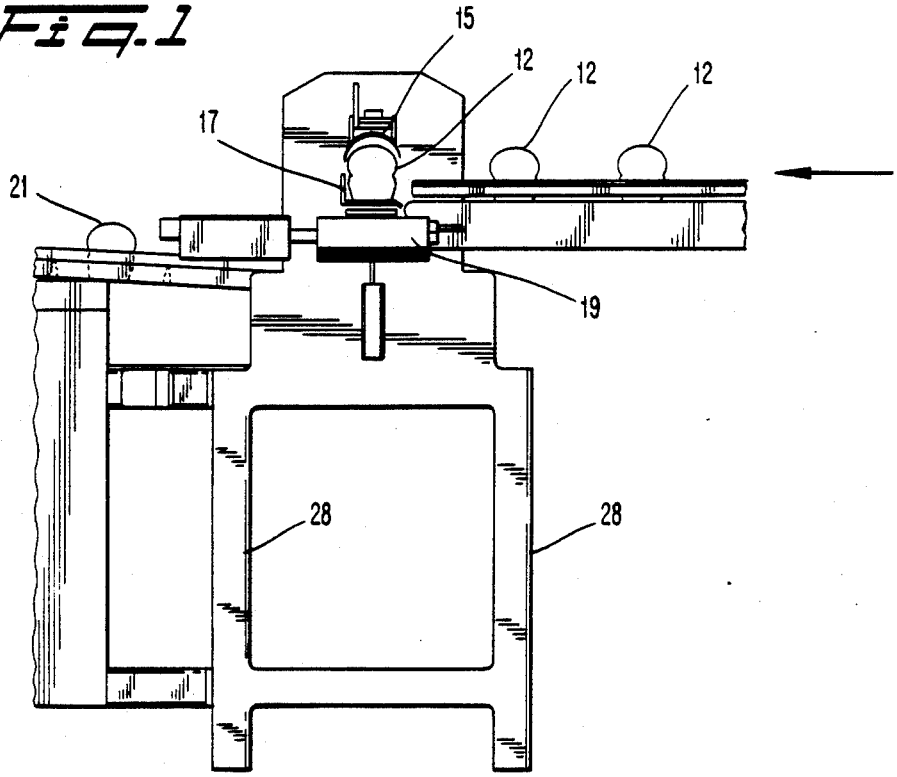
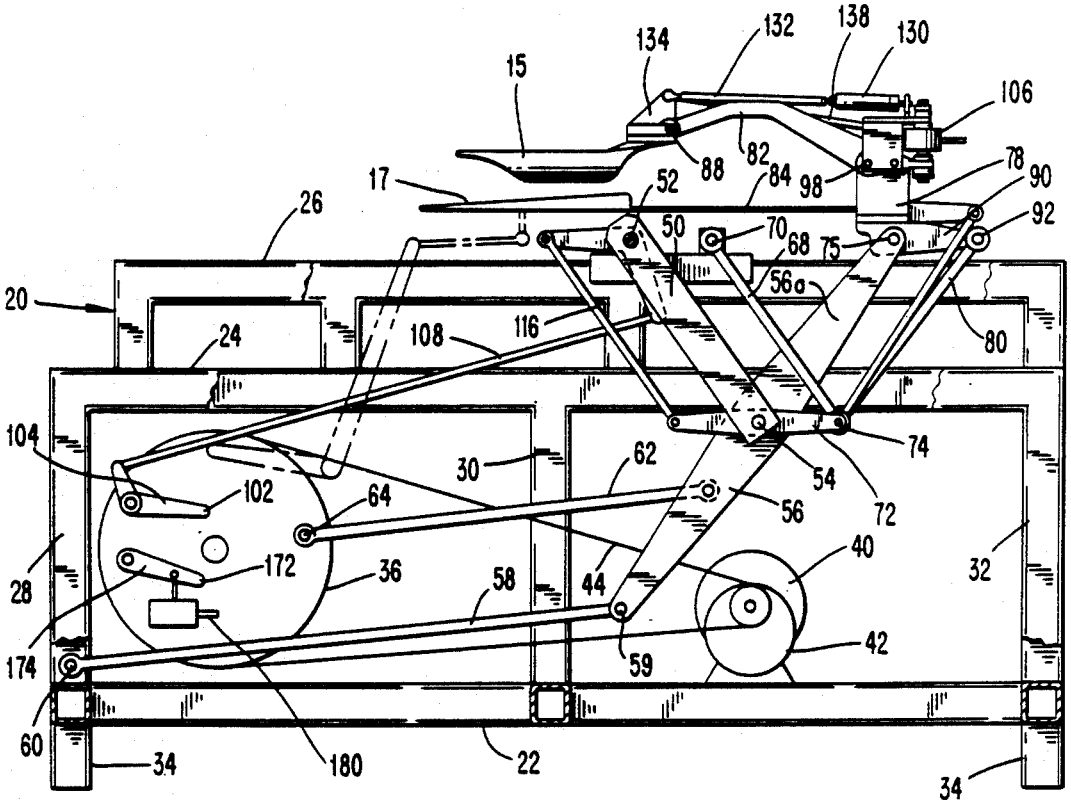
Fig. 2

Fig. 3
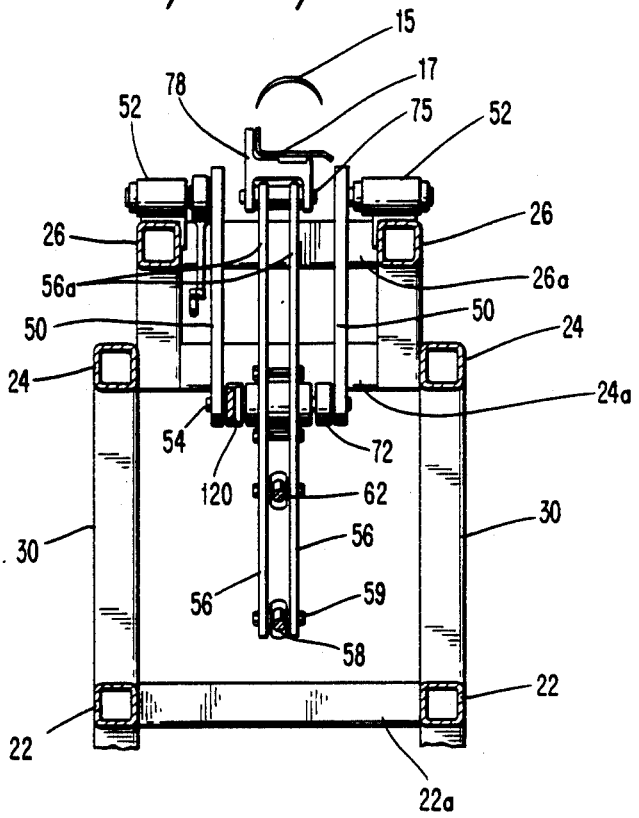
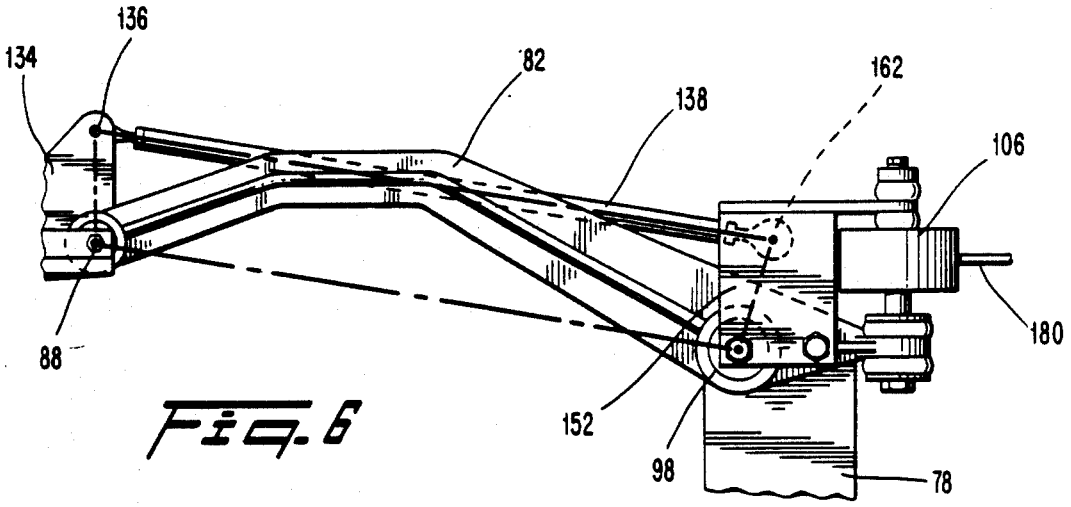
Fig. 6

Fig. 7
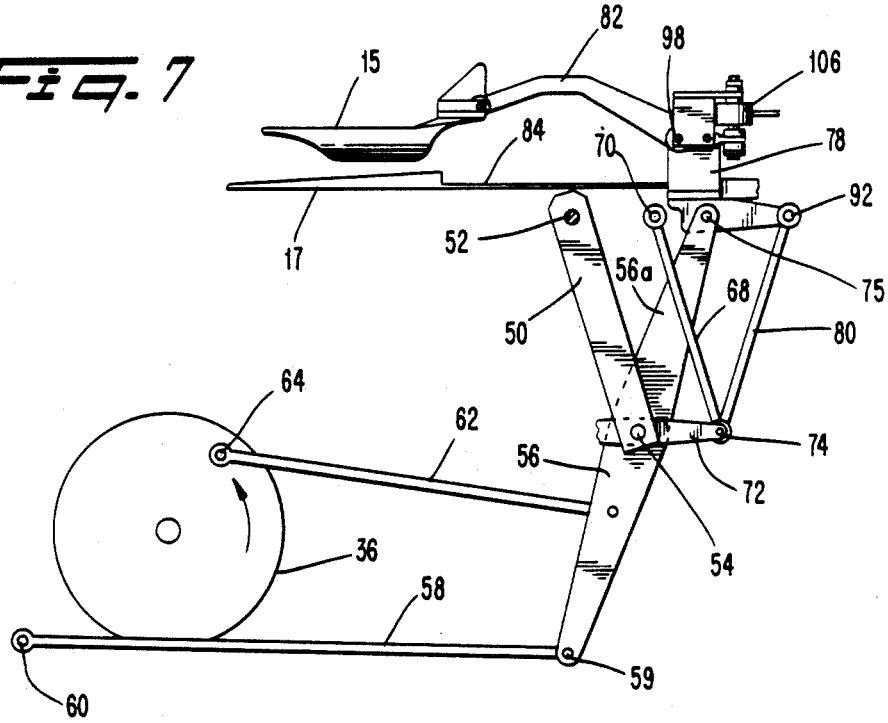
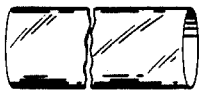
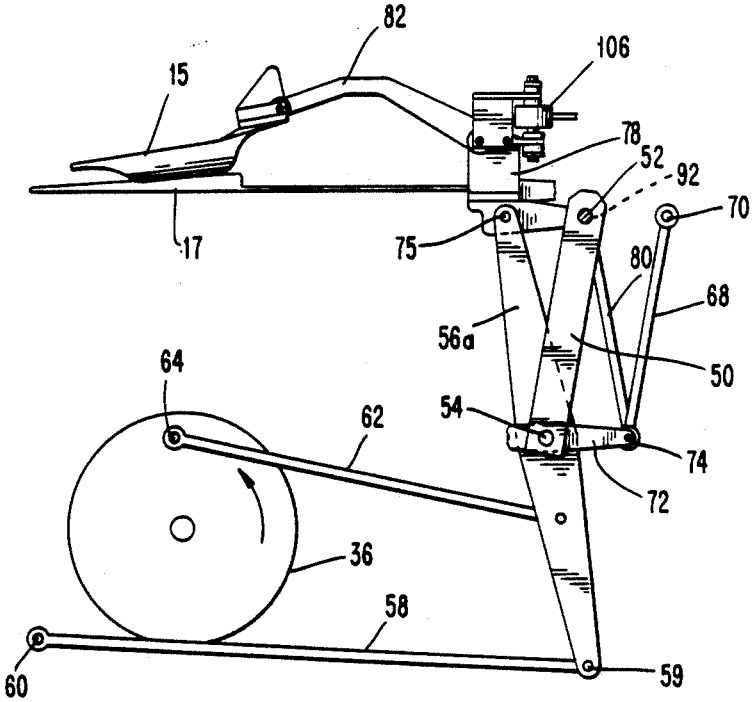
Fig. 8

HIGH SPEED, LOW VIBRATION BREAD BAGGER

BACKGROUND OF THE INVENTION

This invention relates to a bagging apparatus and method that is particularly adapted for use in a commercial bakery for automatically bagging a freshly baked product, such as a loaf of bread, into a plastic bag or wrapper. Commercial apparatus has been marketed for many years by AMF Bakery Products Division, Richmond, Va., for automatically inserting freshly baked loaves of bread into plastic bags or wrappers. U.S. Pat. No. 3,451,192 to J. F. Irwin, assigned to applicant's assignee, describes and claims such a machine that has been commercially used for many years. Although that machine has enjoyed considerable commercial success, its speed of operation is limited to bagging approximately 55 to 60 loaves of bread per minute. At high speeds of operation, the vibration and wear on certain parts of the machine are exceedingly high.

Briefly, the bagger of the Irwin patent operates by first inflating the plastic bag or wrapper that is tubular in shape with one end closed and one end open, then horizontally inserting top and bottom scoop shaped members into the opened bag, then raising the top scoop to hold the month of the bag open, and then returning the scoops and open bag horizontally to pull the bag over a loaf of bread that has been inserted into the path of motion of the open bag. Referring to the drawings of the Irwin patent, which is incorporated in its entirety herein by reference, the top and bottom scoops 114,115 are secured to a horizontally reciprocating shuttle or slide bearing 80 that slides on a horizontally mounted slide shaft 79. The shuttle or slide bearing is reciprocated by means of a long, oscillating lever 61 that is connected to the shuttle by means of an intermediate pivot arm 85. The long oscillating arm is pivoted at its bottom end about a fixed pivot and is driven by means of a drive mechanism that includes a gear box 35.

At the high speeds of 55 to 60 bagging operations per minute, the sliding bearing 80 on which the scoops ride is subject to abrupt stops and starts 110 to 120 times each minute of operation. This creates considerable vibration. Additionally, the long, oscillating lever 61 gains substantial momentum during its pivoting motion and its abrupt changing of directions twice each cycle of operation puts considerable strain and wear on the gear box. The noise cause by this type of operation is considerable and contributes to an unpleasant working environment.

Furthermore, the long, oscillating lever 61 and intermediate pivot arm 85 impart nonuniform velocity to the shuttle member 80 that carries the scoops, thus producing jerking movements during portions of the horizontal reciprocation of shuttle member 80, further adding to vibration, excessive wear, and noise.

A further disadvantage encountered in the Irwin bagging machine is that when adjustments were made to the height of separation of the top scoop from the bottom scoop to accommodate bags of different sizes, the top scoop became inclined or cocked. This led to difficulties in adjusting the tension that the scoops imparted to the open mouths of the plastic bags. Also, the above-mentioned nonuniform and jerking motion of the scoops in their horizontal reciprocations was undesirable in getting the scoops into the mouth of the bag and in pulling the bag over the loaf of bread.

The deficiencies discussed above have resulted in higher than desired repair and maintenance activity, limitation on speed of operation, and undesired vibration and noise during operation.

U.S. Pat. Nos. 3,618,292 and 3,930,352 both show bag scoops that pivot into an inflated bag to hold the bag open to receive bakery buns. However, those scoops are on the sides of the bun packages and the buns are pushed into the open bag by an overhead pusher on an endless belt. The scoops described in those patents move only about three inches during operation and, as mentioned, are positioned on the sides of the bag so that the buns may be pushed into the open bag. Those scoops and their operation are not suitable for a bread bagger where the scoops must be moved approximately 44 inches and where top and bottom scoops pull the bag over a stationary loaf of bread.

SUMMARY OF THE INVENTION

The present invention overcomes the above deficiencies by substituting for the reciprocating shuttle or slide bearing that carries the top and bottom scoops and its oscillating drive lever, a new arrangement of a swinging mechanism that imparts a smooth, relatively quiet motion to the top and bottom scoops that result in substantially less strain and wear on the apparatus, and permits an increase in speed of operation by approximately one-third. Additionally, the top scoop remains substantially horizontal during its horizontal movement regardless of its spacing from the bottom scoop, thereby performing better and more uniformly with bags of different sizes. A pneumatic tensioning system is provided that controls the tension that the scoops apply to the open bag to facilitate bagging of a loaf and removal of the scoops from a bag.

BRIEF DESCRIPTION OF DRAWINGS

The invention will be described by referring to the following drawings wherein:

FIG. 1 is a simplified illustration that shows generally the handling of loaves of bread received from an infeed conveyor, their deposit at the bagger mechanism, and the transfer of bagged loaves to a discharge conveyor;

FIG. 2 is a simplified illustration of the mechanism that horizontally translates top and bottom bag scoops that seize an inflated plastic bag and pull it over a loaf of bread;

FIG. 3 is a simplified sectional view of a portion of the mechanism illustrated in FIG. 2;

FIG. 6 is a more detailed sketch showing the top scoop support arm, the top scoop support bracket and their associated support and pivot means;

FIGS. 7–9 are simplified illustrations showing three successive views during operation of the bagging mechanism of this invention;

DESCRIPTION OF PREFERRED EMBODIMENT

Figure 4:
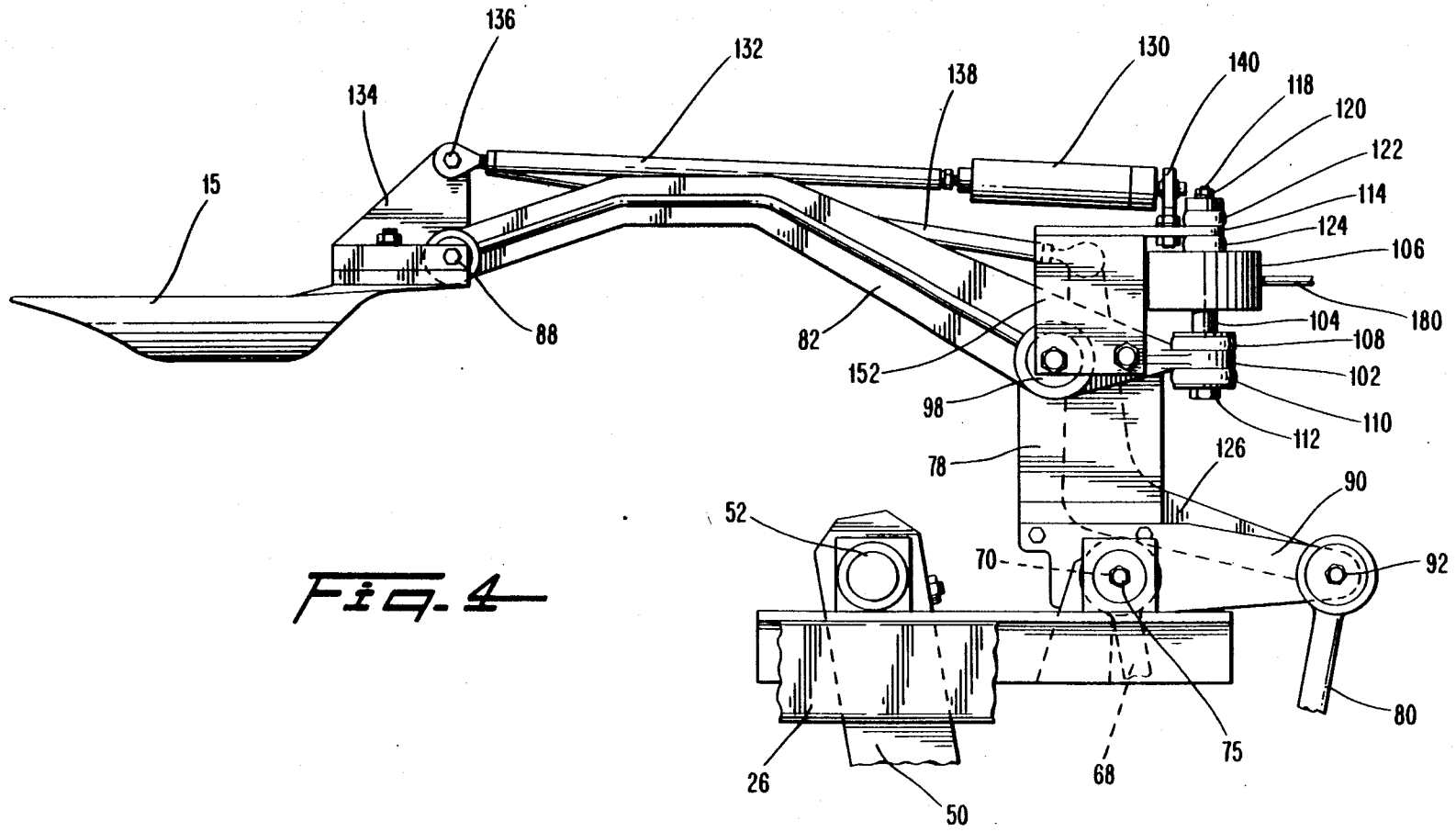
FIG. 4 is an enlarged and more detailed illustration of the top scoop and, its mounting, and a portion of its pivoting mechanism.

Because ~~my~~ invention relates only to the horizontal motion of the top and bottom scoops of a bread bagging machine, to the tilting motion of the top scoop, and to the force applied to the top scoop, in order to more clearly point out the invention, and so as not to make this description too prolix, I will describe in detail only the portion of the bagging machine having to do with performing those functions. The remainder of the bagging machine, such as the details of the driving mechanism, the blockade mechanism that holds a loaf of bread in position on the lower scoop while a bag is pulled over it, and the elevator mechanism that receives the bagged loaf from the bottom scoop and transfers it to the discharge conveyor, will not be described in detail. Those other features of the bagging machine may be as described in the above-mentioned Irwin patent, and may be as previously included in the Mark 50 bread bagger sold by the Bakery Division of AMF Union Machinery, Inc. 2115 West Laburnum Avenue, Richmond, Va. 23227.

Referring to FIG. 1, the general arrangement of a bread bagger is illustrated in which freshly baked loaves of bread 12 are brought to the bagger on input conveyor 13 and are deposited on the bottom scoop 17. Before the loaf is deposited, however, top and bottom scoops 15 and 17 are translated to the left (FIG. 2), the top scoop is tilted toward the lower scoop (FIG. 8) so that they can enter the open mouth of an inflated bag, and then are spread apart, (FIG. 9) to hold the mouth of the bag open. The scoops then are returned horizontally to their starting position during which they pull the inflated bag over the loaf. Although not illustrated in detail FIG. 1, a blockade holds the loaf in a fixed position on the back of the bottom scoop as the bag is drawn over the loaf. The scoops are withdrawn from the bag and the bagged loaf is deposited on an elevator 19 which lowers it to a discharge conveyor 21. This general operation is the same as described in the Irwin patent.

As illustrated in FIG. 2, the apparatus of this invention is supported on a sturdy frame 20 that includes on both sides of the frame three horizontal support members 22,24,26 and three vertical members 28,30 and 32. The outside vertical members include feet 34 for supporting the frame above the floor. Transversely extending members 22*a*, 24*a* and 26*a*, FIG. 3, extend between the similarly numbered, but unprimed, members of the frame.

Figure 12:
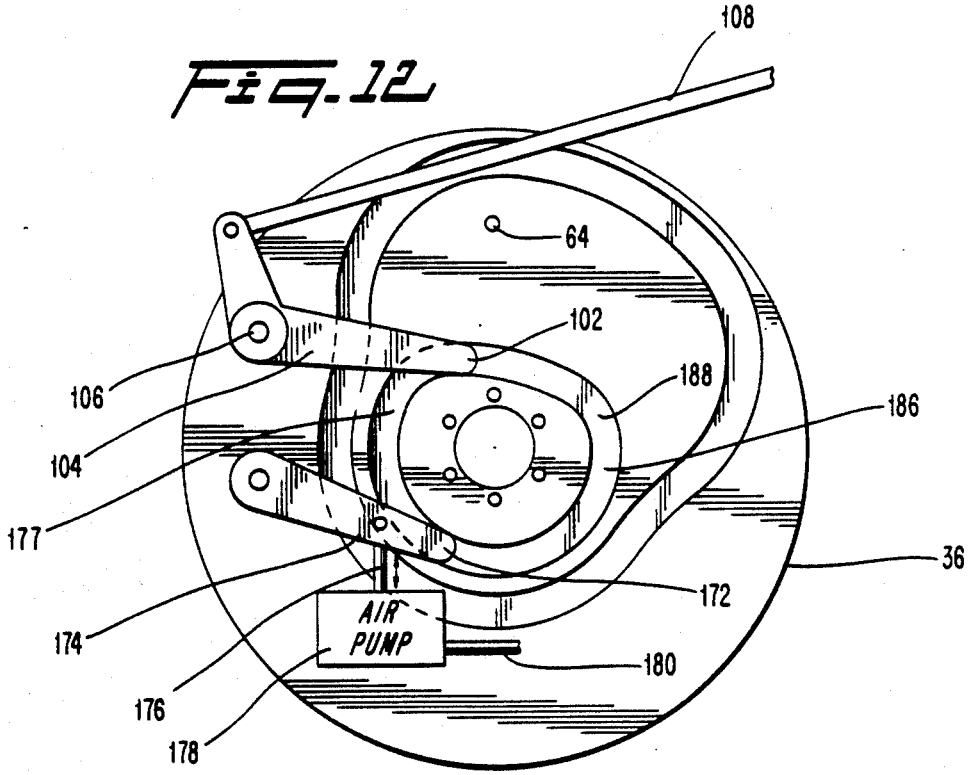
FIG. 12 is an illustration of the face of cam disc showing the cams and cam followers thereon.

The various motions to be described are derived from cams and pivots on a cam disc 36 that is rotated by means of a motor 40, gear reduction box 42, and drive belt 44. Belt 44 may engage a pulley, not visible in FIG. 2, that is axially joined to cam disc 36 so that rotation of the pulley rotates disc 36. The face of the cam disc is illustrated in FIG. 12.

Figure 5:
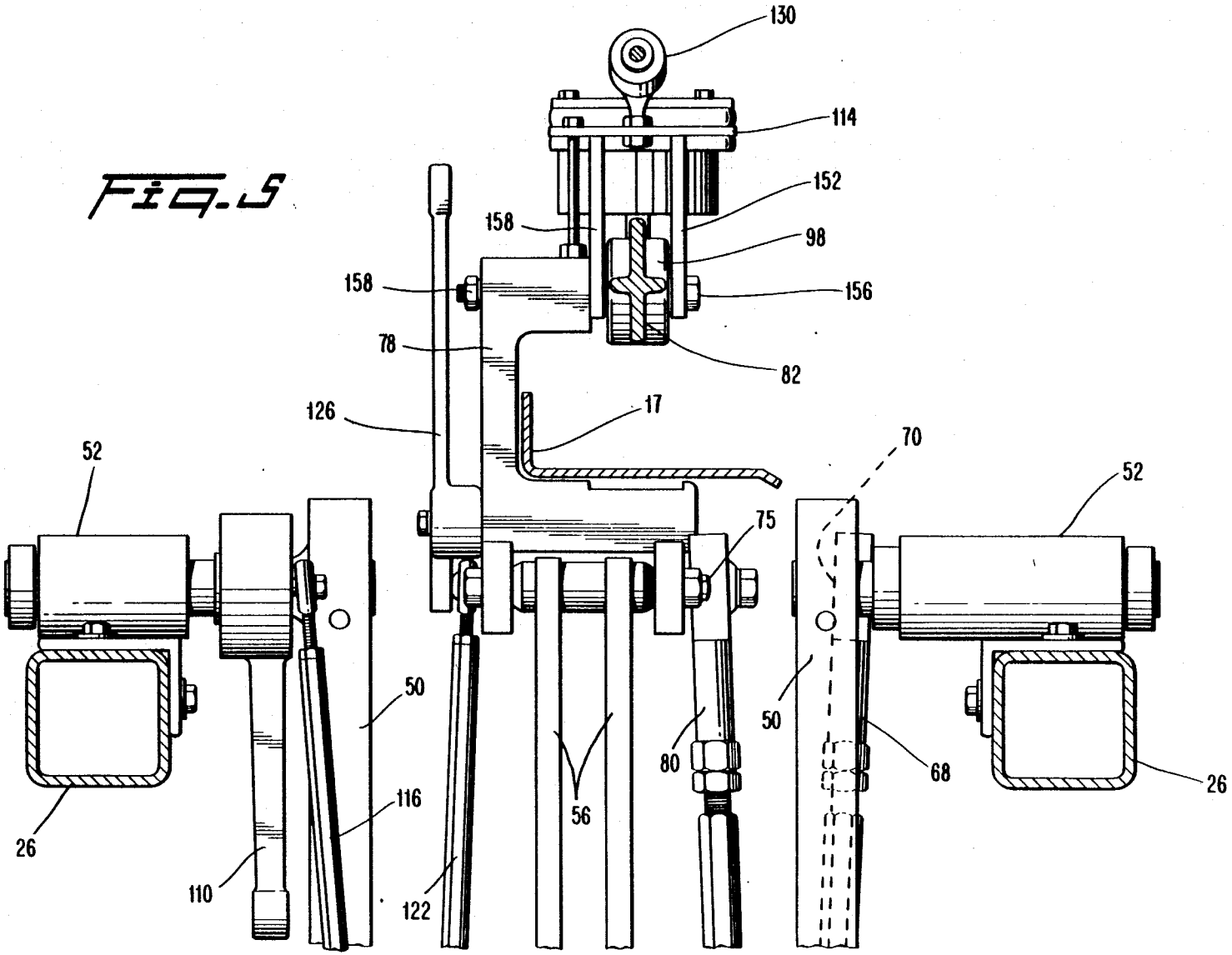
FIG. 5 is a more detailed view of the swinging mechanism and the scoop saddle on which the scoops are mounted.

As seen in FIGS. 2 and 3, the mechanism that reciprocates scoops 15 and 17 with substantially only a horizontal motion is suspended from horizontally extending frame members 26 on the two sides of the frame. As seen in FIGS. 3 and 5, a pair of parallel hanger arms 50 are pivotally suspended from respective pivot means 52 that are secured to frame members 26 on opposite sides of frame 20.

Pivot pin 54 extends between the bottom ends of hanger arms 50 and is fixed to each arm to form a rigid unit that pivots or swings as a single member. A pair of parallel, elongated, closely spaced swinging pivot arms 56 are positioned between hanger arms 50 and are pivotally supported at their mid regions by pivot pin 54. A connecting arm 58 has its right end pivotally connected to the bottom ends of swinging pivot arms 56 and its left end pivotally connected to a transversely located fixed pivot 60 on frame 20.

Crank arm 62 is pivotally joined at its right end to the lower portion of swinging pivot arms 56 and on its left end it is pivotally attached at 64 to cam disc 36 so that crank arm 62 causes swinging pivot arms 56 to swing back and forth in unison and to pivot about pivot pin 54 as cam disc 36 rotates. It is seen that connecting arm 58 restrains the bottoms of swinging pivot arms 56 to an arc about pivot 60.

A single hanger arm 68 that is located on one side of the pair of swinging pivot arms 50, see FIG. 5, is pivotally suspended from a pivot 70 that is secured to frame member 26 on one side of frame 20. Pivot 70 is to the right of pivots 52, as illustrated in FIG. 2. Pivots 52 and 70 are at the same height on frame 20. The bottom end of the single hanger arm 68 is pivotally joined at a pivot 74 to the right end of a rigid horizontal strap member 72. The left end of strap 72 is pivotally supported by pivot pin 54.

The lengths of the first and second hanger arms 50 and 68 are equal, and the distance between pivots 52 and 70 is equal to the length of rigid strap 72 between pivots 54 and 74. These members therefore form a parallelogram whose one side between pivots 52 and 70 is fixed.

The top ends of swinging pivot arms 56 are pivotally joined at pivot 75 to a scoop saddle 78 that fixedly supports top scoop arm 82 and bottom scoop arm 84. As illustrated, bottom scoop 17 is fixedly secured to its arm 84. Top scoop 15 is joined to its arm 82 by means of pivot 88. Scoop saddle 78 has a tail portion 90. A stabalizing rod 80 is pivotally supported between the pivot 74 on the right end of strap 72 and pivot 92 on the tail portion 90 of scoop saddle 78. The means for pivoting top scoop 15 about pivot 88 will be described below.

As seen in more detail in FIG. 4, top scoop support arm 82 is pivotally supported by pivot 98 on scoop saddle 78. The right end of top scoop support arm 82 terminates in an eyelet 102 that receives the shaft 104 of a piston that is within pneumatic cylinder 106. Elastomeric washers 108,110, and bolt 112 maintain eyelet 102 on shaft 104. The top of the housing of pneumatic cylinder 106 is secured to support plate 114 which is secured to scoop saddle 78 by means of an attached bolt 118 and nut 120. Elastomeric washers 122 and 124 form part of the connection.

Referring to FIGS. 4 and 5, it is seen that plate 114 has two spaced, vertical plates 150 and 152 welded to its bottom surface. Vertical plates 150 and 152 extend over opposite sides of top scoop arm 82 and its bearing member 98. A bolt 156 passes through plates 150, 152, bearing 98, and the top portion of scoop saddle 78, and is held by nut 158. Another bolt, not visible in FIG. 5, also holds plates 150,152 to saddle 78. It thus can be seen that the housing of pneumatic cylinder 106 is secured to saddle 78 and the piston of the cylinder is secured to the right end of top scoop arm 82. Since arm 82 pivots on saddle 78 by means of bearing 98, the the height of arm 82 is a function of the position of the piston arm 104 in cylinder 106. More will be explained about the activation of cylinder 106 below.

It is not uncommon that commercial bakeries are required to use bags of different diameters to package different types of bread loaves. This requires that the separation between the top and bottom scoops be different for bags of different diameters. In order for the two scoops to engage the bag in the same manner regardless of the diameter of the bag, it is necessary that the scoops be horizontal regardless of their separation. Of course, the dipping of the top scoop when it enters the mouth of the bag is a different matter since it is not then in contact with the bag. One of the deficiencies of the machine described in the Irwin patent is the scoops are parallel at only one spacing. When the spacing between scoops changed, the top scoop became inclined. That deficiency is overcome in the present invention and the scoops remain horizontal regardless of the spacing between them.

Reference now will be made to FIG. 6 to see why scoop 15 remains parallel to scoop 17 regardless of the height of arm 82. In the simplified illustration of FIG. 6, it is seen that the top scoop bracket 134 is pivotally connected to the left end of top scoop arm 82 and to the left end of connecting rod 138. It is seen that pivot points 88 and 136 are substantially vertically aligned. Top scoop arm 82 pivots about its bearing member 98 and connecting rod 138 pivots about point point 162. It is seen by the dashed construction lines that the four pivot points 98,162,134, and 88 are the corners of a quadralateral whose right side 98–162 remains fixed as arm 82 and connecting rod 138 raise or lower. By drawing arcs through points 88 and 136 from their respective centers of curvature 98 and 162, it will be seen that the side 88–136 of the structure remains substantially vertical as arm 82 raises or lowers. Since bracket 134 maintains its same orientation in space as arm 82 pivots up or down, top scoop 15 remains horizontal.

A cylinder 130 and connecting rod 132 pivotally connect the top scoop bracket 134 to an eyelet 140 that is secured to plate 114 on saddle 78. This link comprised of damping cylinder 130 and link 132 function as a spring in compression to keep in tension the linkage that produces the dipping motion of top scoop 15, as will be explained in more detail below.

Figure 9:
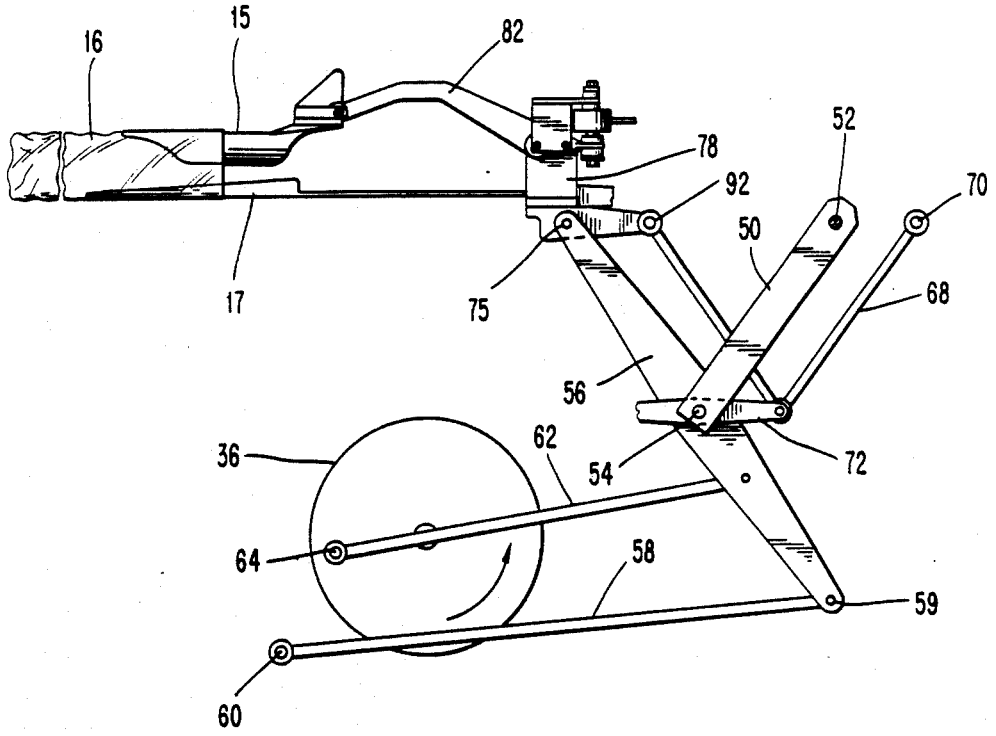

At this point in the description it will be helpful to discuss solely the horizontal movement of the scoops from their fully retracted positions illustrated in FIGS. 2 and 7 to their left-most positions in FIG. 9 at which they have entered an inflated bag and are ready to hold the mouth of the bag open and pull the bag over a loaf of bread that has been deposited on the rear of the bottom scoop by the infeed conveyor 13. The dipping of the top scoop as it enters an inflated bag will be explained below.

Assuming that cam disc 36 is rotating counterclockwise and is just arriving at its position illustrated in FIG. 2, crank arm 62 pushes the tops of swinging pivot arms 56 and scoop saddle 78 to their extreme right position since connecting arm 58 holds the bottoms of the swinging arms 56. The pushing action of crank arm 62 causes the pair of hanger arms 50 and the pivot pin 54 to pivot in a counterclockwise direction about pivot points 52. Because the lengths of hanger arms 50 between pivots 52 and 54 is equal to the length of the top portions **56*a* of swinging pivot arms 56 that extend between pivots 54 and 75, and because fixed pivots 52 and 70 are at the same height on frame 20, the motion of the pivot point 75 on the front of scoop saddle 78 is solely in a horizontal direction that is in line with fixed pivots 52 and 70**. As it is illustrated in FIG. 2, scoop saddle is at its extreme withdrawn position.

The single hanger arm 68 is on one side of swinging pivot arms 56 and is the same length as, and parallel to, the first hanger arms 50. Stabalizing arm 80 is the same length as the single second hanger arm 68 and the same length as, and parallel to, the top halves **56*a* of swinging lever arms 56 that extend between pivots 54 and 75. The distance between pivots 54 and 74 is equal to the distance between pivots 75 and 92. Consequently, a second parallelogram is formed comprised of the top portions 56*a* of the swinging pivot arms, strap 72, stabalizing arm 80, and the portion of scoop saddle 78 between pivots 75 and 92**.

FIG. 7 shows that pivot pin 64 on cam disc 36 has moved somewhat to the left and, via crank arm 62, has begun to pivot swinging pivot arms 56 in a counterclockwise direction about the pivot 59 at the end of connecting arm 58. Comparing FIGS. 2 and 7, it is seen that arms **50,68,56*a* and 80 are less inclined in FIG. 7 than in FIG. 2, and since the tops of arms 50 and 68 are pivoted to frame 20, the tops of arms 56*a* and 80, and thus scoop saddle 78, have moved to the left. It is noted that pivots 75 and 92 on scoop saddle 78 still are horizontally aligned with the fixed pivots 52 and 70**.

FIG. 8 shows that pivot pin 64 on cam disc 36 has moved farther to the left and has pulled swinging pivot arms 56 beyond their vertical position so that they now are inclined toward the left of fixed pivot point 52. Hanger arms 50 also are inclined in a direction opposite from that shown in FIG. 2. Again, pivot points 75 and 92 on scoop saddle 78 remain horizontally aligned with fixed pivot points 52 and 70.

FIG. 9 shows pivot pin 64 on cam disc 36 at its extreme left position at which connecting arm 62 extends through the center of the cam disc. In this position, swinging pivot arms 56 are in their leftmost position so that scoops 15 and 17 will enter an inflated bag 16. In comparing FIGS. 2 and 9, it is seen that scoop saddle 78 has moved from the right side to the left side of fixed pivot points 52 and 70. Its motion is in a straight line with the pivot points 75 and 92 on scoop saddle 78 parallel to the line joining fixed pivot points 52 and 70. In practice, scoops 15 and 27 move approximately 44 inches from one extreme horizontal position to the other.

Figure 10:
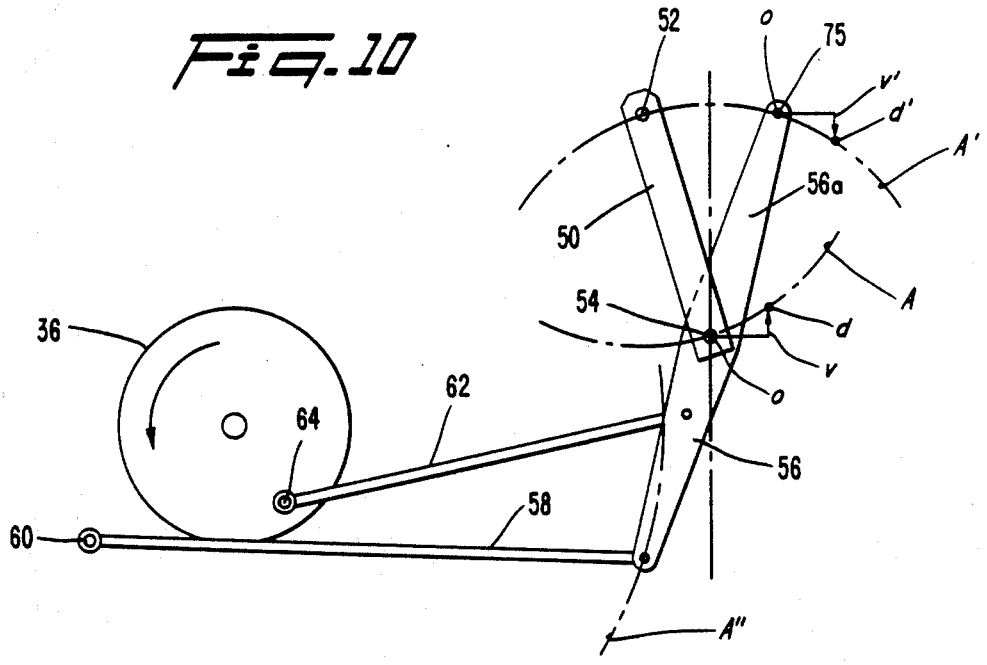
FIG. 10 is a simplified geometric construction diagram that is used in explaining the operation of the novel mechanism of this invention.

It is believed that the simple construction diagram of FIG. 10 will help illustrate why scoop saddle 78 moves solely in a horizontal direction as it oscillates back and forth between its extreme positions. Keeping in mind that pivot point 52 from which hanger arms 50 are suspended, and pivot point 60 about which connecting arm 58 pivots, are the only pivot points that are fixed to frame 20, and keeping in mind that the length of hanger arms 50 between pivots 52 and 54 are equal to the lengths of swinging pivot arms **56*a* that extend between pivots 54 and 75, it will be appreciated that the radius of curvature of arc A that passes through pivot pin 54 is equal to the radius of curvature of arc A′ that passes the pivot point 75. Therefore, as pivot point 54 moves upwardly to the right on arc A a distance 0–d, for example, arms 50 and 56 must spread open and pivot point 75 on swinging pivot arms 56 must move down its arc A′ a distance 0–d′. Because arms 50 and 56*a*** comprise an equalateral triangle, the distance 0–d is equal to the distance 0–d′. Therefore, the vertical components v and v′ of the respective movements along segments 0–d and 0–d′ are equal and in opposite directions. As a result, pivot point 75 remains in the same horizontal plane that passes through the fixed pivot points 52. Throughout their full arcs of travel, pivot points 54 and 75 have this equal and opposite movement along their respective arcs A and A' so that the resultant movement of pivot point 75 is solely horizontal.

It will be noted that the pivoting movement of connecting arm 58 along its arc A" has the effect of causing hanger arms 50 and swinging pivot arms 56 to spread apart or to move closer together as pivot point 59 raises or lowers. But arms 50 and 56 always maintain the equalateral triangle relationship. Therefore, the operation described immediately above occurs and as a result of the geometry selected, the pivot point 75 moves solely in a horizontal direction.

Figure 11:
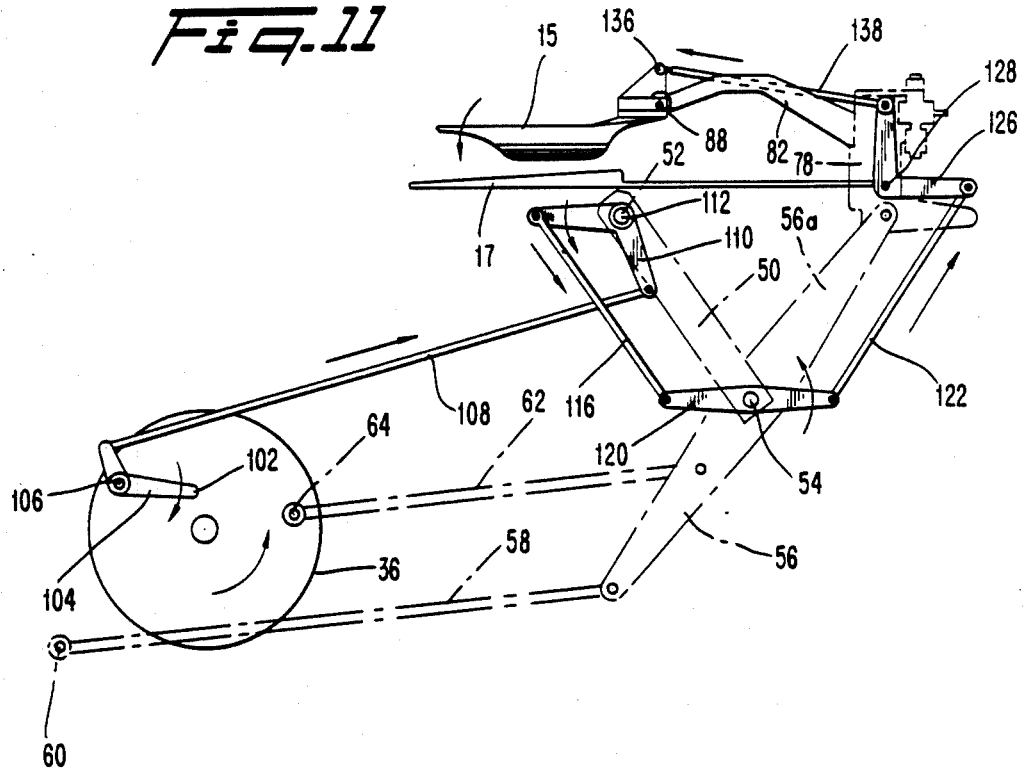
FIG. 11 is a simplified illustration of the linkage that causes the top scoop to dip toward the lower scoop during a portion of its operation.

The mechanical linkage that causes top scoop 15 to dip toward bottom scoop 17 before the scoops enter an inflated bag (FIG. 8) is illustrated in simplified form in FIG. 11. This linkage is located on the left side of the pair of swinging pivot arms 56, FIG. 5, and opposite to the side occupied by the second hanger arm 68 and stabalizing arm 80. The linkage of interest here is shown in solid lines in FIG. 11 and a portion of the mechanism for translating the scoops horizontally is shown in broken lines for purpose of reference and orientation. The relationship of this linkage to the remainder of the bagger mechanism is best seen in FIG. 2.

In FIG. 11, cam follower 102 on bell-crank lever 104 follows in its corresponding cam track 186 on cam disc 36, FIG. 12, to cause the lever to pivot in a clockwise direction around its pivot point 106 that is fixed to frame 20. Arm 108 that is connected to the end of the vertical arm of lever 104 moves to the right and rotates a second bell-crank lever 110 in a counterclockwise direction around its pivot joint 112. Bell-crank lever 110 pivots on the same fixed pivot 52 as one of the hanger arms 50. Lever 110 pushes connecting link 116 downwardly to rotate lever arm 120 in a counter clockwise direction about pivot pin 54. It is seen that pivot pin 54 is the pivot connection between hanger arms 50 and the swinging pivot arms 56. Rotating lever 120 raises connecting rod 122 to rotate bell-crank lever 126 in the counterclockwise direction about its pivot 128. Pivot 128 is carried on scoop saddle 78. Bell-crank lever 126 pushes connecting rod 138 to the left, and by way of pivot 136, cause top scoop 15 to pivot downwardly about its pivot 88 on the end of arm 82.

After scoops 15 and 17 enter an inflated bag, cam follower 102 is moved radially outwardly to the high portion of its cam, thereby rotating bell-crank lever 104 in the counterclockwise direction. The linkage connected to pivot 88 moves in directions opposite to those described immediately above to rotate top scoop 15 to its horizontal position illustrated in FIG. 9, whereby the scoops hold open the mouth of the bag.

The blockade mechanism is not illustrated in detail in the drawings since it may be similar to that shown in the Irwin patent. A vertical member 27 and its actuating linkage is illustrated in broken lines in FIG. 2 for completeness of disclosure.

An attractive feature of the bagger improvement of this invention is that the air pressure applied to pneumatic cylinder 106 is varied during a cycle in order to facilitate the handling of the bag and loaf by the scoops 15 and 17. Referring to FIGS. 2, 4 and 12, cam follower 172 of lever arm 174 rides in cam 177 which is the cam for controlling the dip of top scoop 15 and for controlling the air pressure that is applied to scoop cylinder 106. The opposite end of lever arm 174 is pivotally connected to frame 20. Lever 174 is pivotally connected by link 176 to the piston of air pump 178. As link 176 and the piston move downwardly, the air pressure in pump 178 increases and applies air to output line 180. Line 180 is connected to scoop cylinder 106. When the piston of air pump 178 moves down it causes air to be pumped to scoop cylinder 106 to increase the pressure and volume between the cylinder and piston 104 and push the right end of top scoop arm 82 downwardly. Arm 82 pivots in the clockwise direction about pivot 98 to raise the left end of arm 82 and top scoop 15. The length of the right end of arm 82 between pivot 98 and eyelet 110 is approximately one-tenth the length of arm 82 between pivots 98 and 88. Therefore, a one-half inch movement of the piston of scoop cylinder 106 results in a five inch vertical movement of scoop 15, as an example.

Assume that scoop saddle 78 and scoops 15 and 17 are at their extreme withdrawn position, as illustrated in FIG. 2, and that they are just beginning to move to the left toward an inflated bag. Referring to FIG. 12, cam disc 36 will be rotated so that cam 177 is at a position wherein cam follower 172 rises to the beginning of the high portion 186 of the cam. This pushes lever 174 downwardly so that the pressure in the pump 178 increase and causes an increased volume of air to be pumped through hose 180 to scoop cylinder 106. This pushes piston 104 downwardly to raise arm 82 and top scoop 15.

In practice, the heights of arm 82 and scoop 15 are adjusted so that they are high enough to open and properly hold the largest diameter bread bag that the bakery is likely to handle. In this situation, scoops 15 and 17 hold the bag open with a pressure of the order of five to six pounds being applied to the bag.

Continuing with the description of the bagging operation and the operation of scoop cylinder 106, when scoops 15 and 17 enter an inflated bag and hold it open they are at their extreme left positions. They then begin to return to the right and begin to draw the bag over a loaf of bread that is resting on the right-hand end of the bottom scoop. The blockade holds the loaf and prevents it from moving with the bottom scoop. The apparatus is synchronized so that at the time the heel on the left end of the loaf encounters the closed end of the bag, cam disc 36 has rotated so that cam follower 172 is entering the low portion 188 of the cam. This causes lever 174 to rotate in a counterclockwise direction to raise the piston of air pump 178 and decrease the pressure in air pump 178 and scoop cylinder 106. This reduced pressure allows the force applied to the bag by top scoop 15 to decrease and allows the scoops to be withdrawn from the bag with a reduced amount of friction. This operation also minimizes the compression of the loaf between the end of the bag and the blockade as the scoops are withdrawn.

In the event that a smaller diameter bag is used, top scoop 15 will exert the five or six pounds of pressure against the smaller bag when the scoops first engage the inflated bag. Assuming that the bag is two inches smaller in diameter, for example, and remembering the ten-to-one difference in lengths of arm 82 on the two sides of pivot 98, the piston of scoop cylinder 106 will try to move only 0.2 inch. This is such a small distance, and the air regulator (not illustrated) that supplies air under pressure to air pump 178 operates with such a wide tolerance that, in effect, the arm 82 "stalls out"

and holds the mouth of the bag open with approximately the same force applied to the smaller bag as was applied to the larger bag. It is for this reason that adjustments in the pneumatic system are not required for different-sized bags.

From the above description it is seen that the improved mechanism of this invention significantly reduces vibration and wear on the parts of the apparatus by providing smoothly swinging pivot arms that pivot intermediate their lengths, and by providing associated mechanisms that are so constructed and arranged that the scoop saddle and scoops move solely in a horizontal direction. The top scoop remains horizontal within the mouth of an open bag and, as a result of the construction and pneumatic activator, exerts substantially the same force against the bag regardless of the diameter of the bag. The above features substantially eliminate the need for making adjustments to the machine each time a different size bag is used.

Because the vibration in the machine of this invention has been reduced substantially, the speed of operation of the bread bagger has been increased from about 55 to 60 operations per minute to approximately 75 to 80 operations per minute.

In its broader aspects, this invention is not limited to the specific embodiment illustrated and described. Various changes and modifications may be made without departing from the inventive principles herein disclosed.

I claim:

1. In a high speed, low vibration bagger for automatically inserting bakery products of bread into a bag that is open on one end, the combination comprising a frame having support means positioned above the floor, hanger means pivotally supported on said support means of the frame and hanging downwardly therefrom, a first pivot means fixed fixed to the bottom end of said hanger means, elongated swinging pivot arm means pivotally supported proximate its mid region on said first pivot means and adopted to be inclined upwardly within said frame, the length of the top end of the swinging pivot arm means down to its pivot support on the first pivot means being the same length as said hanger means between its pivot support and the first pivot means, means pivotally connecting the bottom of said swinging pivot arm means to a transverse location on said frame, scoop supporting means connected to the top end of said swinging pivot arm means, first and second bag scoops mounted on the scoop supporting means, and motive means for pivoting the swinging pivot arm means about the first pivot means and swinging said hanger means about its support means to the extent permitted by the pivotable that is connected to the bottom of the swinging pivot arm means, whereby said scoop supporting means is reciprocated substantially solely in a horizontal direction as the swinging pivot arm means is reciprocated about the first pivot means by the motive means.

2. The high speed, low vibration bagger claimed in claim 1 and including, second hanger arm means pivotally supported at its top end of said support means at a horizontally spaced position from the first-named support means and in the direction of movement of the scoops when withdrawing from a bagged product, said second hanger arm means being the same length as said first hanger means, rigid strap means pivotally connected to the bottom end of the second hanger arm and to said first pivot means, said strap means being the same length as and parallel to a line extended between the pivot supports for the hanger means and second hanger arm on said support means, a stabilizing arm pivotally connected at one end to said bottom end of said second hanger arm means and said strap means and pivotally connected at its other end to a location on the scoop supporting means that is horizontally spaced from the location where said swinging pivot arm means is connected, said stabalizing rod being parallel to said swinging pivot arm means, whereby said scoop support means translates substantially solely horizontally when the swinging pivot arm means pivots about the first pivot means.

3. The high speed, low vibration bagger claimed in claim 1 wherein said motive means includes a crank arm pivotally coupled to and extending transversely from the bottom portion of the swinging pivot arm means.

4. A high speed, low vibration bread bagger for automatically inserting a loaf of bread into a bag that is open on one end, a frame for supporting said bread bagger above the floor, a first hanger arm means pivotably supported on said frame and hanging downwardly from the frame toward the floor, a first pivot means extending horizontally from the bottom end of said first hanger means, elongated swinging pivot arm means pivotally supported proximate its mid region on first pivot means, the length of the swinging pivot arm means from its top end to its pivot support arm said first pivot means being the same length as said hanger arm means, means pivotally connecting the bottom portion of said swinging pivot arm means to a transversely located pivot on said frame, scoop supporting means coupled to the top end of said swinging pivot arm means, top and bottom bag scoops mounted on the scoop supporting means, and means coupled to the bottom portion of said swinging arm means for pivoting the swinging pivot arm about the first pivot means and thereby pivoting said first hanger arm means about its pivotal support on the frame, whereby said scoop supporting means is translated substantially solely in a horizontal direction as the swinging pivot arm means is reciprocated about the first pivot means.

5. In a high speed, low vibration bread bagger for automatically inserting loaves of bread into a bag that is open on one end, the combination comprising a frame having first and second spaced support means positioned above the floor, a pair of spaced, parallel, hanger arms each pivotally supported on a respective support means of the frame and hanging downwardly from said support means, a first pivot means extending between and fixed to the bottom ends of said spaced hanger arms, elongated swinging pivot arm means pivotally supported proximate its mid-region on said first pivot means, the length of the top end of the swinging pivot arm means down to its pivot support on the first pivot means being the same length as said hanger arms between their pivot supports and the first pivot means, connecting arm means pivotally connecting the bottom of said swinging pivot arm means to a transverse location on said frame, scoop supporting means connected to the top end of said swinging pivot arm means, top and bottom bag scoops mounted on the scoop supporting means, and motive means coupled to the bottom half of said swinging pivot arm means for pivoting the swinging pivot arm means about the first pivot means and pivoting said hanger arms about their support means to the extent permitted by the pivotable connecting arm means, whereby said scoop supporting means is reciprocated substantially solely in a horizontal direction as the swinging pivot arm means is reciprocated about the first pivot means by the motive means.

6. The high speed, low vibration bread bagger claimed in claim 1 and including, second hanger arm means pivotally supported at its top end on one of said support means at a horizontally spaced position from one of the first-named support means and in the direction of movement of the scoops when withdrawing from a bagged loaf of bread, said second hanger arm means being the same length as said parallel hanger arms, rigid strap means pivotally connected to the bottom end of the second hanger arm and to said first pivot means, said strap means being the same length as and parallel to a line extended between the pivot supports for the hanger arm and second hanger arm on said one support means, a stabilizing arm pivotally connected at one end to said bottom end of said second hanger arm means and said strap means and pivotally connected at its other end to a location on the scoop supporting means that is horizontally spaced from the location where said swinging pivot arm means is connected, said stabalizing rod being parallel to said swinging pivot arms means, whereby said scoop support means translates substantially solely horizontally when the swinging pivot arm means pivots about the first pivot means.

7. The high speed, low vibration bread bagger claimed in claim 1 wherein said motive means includes a crank arm pivotally coupled to and extending transversely from the bottom portion of the swinging pivot arm means.

8. The high speed, low vibration bread bagger claimed in claim 2 and further including, means pivotally mounting said top scoop to said scoop supporting means, and means for causing said top scoop to pivot toward the bottom scoop at one end of the horizontal travel of the scoops, whereby said scoops may better enter the open mouth of an inflated bag that is positioned proximate said one end of travel of the scoops.

9. In a high speed bagger for automatically inserting loaves of bread into a bag wherein empty bags are stacked at a first location and spaced scoops are translatable from a second position to said first position where they enter and open bag and wherein one of the scoops is on one end of an arm that is pivotable about a point intermediate its ends to permit said one scoop to move toward and away from the other scoop so that the scoops, when apart, hold a bag open while at the first position, and wherein the scoops pull the open bag over a loaf of bread that has been positioned in the path of movement of the scoops back to their second position, and wherein means are provided to hold the loaf substantially stationary as the bag is pulled over it, the improvement, comprising means for applying a predetermined force to said opposite end of the arm when the scoops are first inserted into the open bag, and for reducing said force after the loaf is within the bag, thereby to facilitate withdrawal of the scoops from the bag as the scoops return to said second position and the bagged loaf remains at a third position that is intermediate the first and second positions.

10. The combination claimed in claim 9, wherein, said means for applying a variable force to said opposite end of the arm comprises, a cylinder and piston arrangement coupled between said opposite end of the arm and the support means for said arms.

11. The combination claimed in claim 10 and including, means for supplying fluid to said cylinder and piston means and, means synchronized with the movement of the scoops from their first to their second positions for applying fluid at a first pressure to said cylinder and piston means when said scoops are first within the mouth of an open bag and for supplying fluid at a second and lower pressure to said cylinder and piston means after the loaf is within the bag, thereby to facilitate removal of the scoops from within the open end of the bag.

* * * * *